US006201199B1

(12) United States Patent
Chew et al.

(10) Patent No.: US 6,201,199 B1
(45) Date of Patent: Mar. 13, 2001

(54) BUTTON LOCK MECHANISM FOR HANDHELD DEVICE

(75) Inventors: Kwan Wee Anthony Chew; Soo Huat Quek, both of Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/383,112

(22) Filed: Aug. 25, 1999

(51) Int. Cl.[7] ..... H01H 1/52
(52) U.S. Cl. ..... 200/318; 200/318.2
(58) Field of Search ..... 200/43.16, 43.18, 200/318.1, 318.2, 321, 322

(56) References Cited

U.S. PATENT DOCUMENTS 3,611,357 * 10/1971 Boulanger ..... 340/365
4,385,509 * 5/1983 Milles et al. ..... 70/304
5,570,612 * 11/1996 Reasoner ..... 74/502.6
5,638,945 * 6/1997 Fukinuki et al. ..... 200/43.17

* cited by examiner

*Primary Examiner*—Michael L. Gellner
*Assistant Examiner*—Nhung Nguyen

(57) ABSTRACT

A lockable button mechanism for use in a portable device. The mechanism includes three button elements aligned with three switch elements, whereby the button elements may be individually depressed to activate respective switch elements. The mechanism further includes a locking element interposed between the switch elements and the button elements, the locking element being slidably displaceable between a first position in which depression of the button elements is enabled, and a second position in which the locking element blocks depression of the button elements.

1 Claim, 6 Drawing Sheets

BUTTON LOCK MECHANISM FOR HANDHELD DEVICE

This invention relates to a button lock mechanism for use in a portable device.

Portable electronic devices often include buttons on the outside of the device casing which can be pressed by a user to activate various functions of the device. For example, the latest generation of handheld computers are known to include audio buttons which enable a user to record and play voice memos without having to open a cover of the device.

In order to avoid inadvertent activation of the audio buttons, some handheld computers include a switch which electronically locks the audio buttons. When this switch is in an unlocked state, the audio buttons may be pressed to activate an associated electronic audio function of the computer. However, when the switch is in a locked state, the audio buttons may be pressed without activating any electronic functions.

Typically, the electronic locking switch comprises a switch element which is coupled to the microprocessor of the computer by an electrical sense line.

A mechanical button lock is a less common approach to avoiding accidental button activation. This approach is used in the Series 5 portable computer, available from Psion, UK. During transit, a portion of the Series 5 device casing surrounding the audio buttons can be configured so as to be flush with the audio buttons. In this configuration, the button are less likely to be accidentally depressed. When it is desired to use the audio buttons, a user can manually slide and depress the surrounding casing portion to reveal the audio buttons for activation.

According to the present invention there is provided a lockable button mechanism for use in a portable device comprising; a switch element, a button element aligned with the switch element, the button element being depressible in a first direction to activate the switch element, and a locking element substantially interposed between the switch element and the button element, the locking element being slidably displaceable in a transverse direction to the first direction, between a first position in which depression of the button element is enabled, and a second position in which the locking element blocks depression of the button element.

A lockable button mechanism in accordance with the invention has the advantage that it provides a simple solution for locking a button, such as an audio button of a portable electronic device. The simplicity of the lockable button mechanism enables it to be implemented in a relative small space with relatively low cost. Unlike the electronic locking switch, the button lock according to the invention does not require a switch element or an electrical sense line which can be expensive and costly to implement.

In a preferred embodiment, the mechanism comprising a plurality of switch and button element pairs which are lockable with a single locking element.

Ideally, the lockable button mechanism is incorporated in a portable device. Suitably, the button and locking elements are displaceable relative to the housing or casing of the device and are partially exposed by openings in the housing, with the switch element or elements being substantially fixed within the housing.

A further advantage of a lockable button mechanism in accordance with the invention is that the switch element or elements are protected in the locked state. If the buttons elements experience an impact, for example when the portable device is inadvertently dropped, the locking element will block the path of the button elements and prevent the relatively fragile switch elements being damaged.

Embodiments of the invention will now be described, by way of example, with reference to the accompanying drawings, in which.

Figure 2:
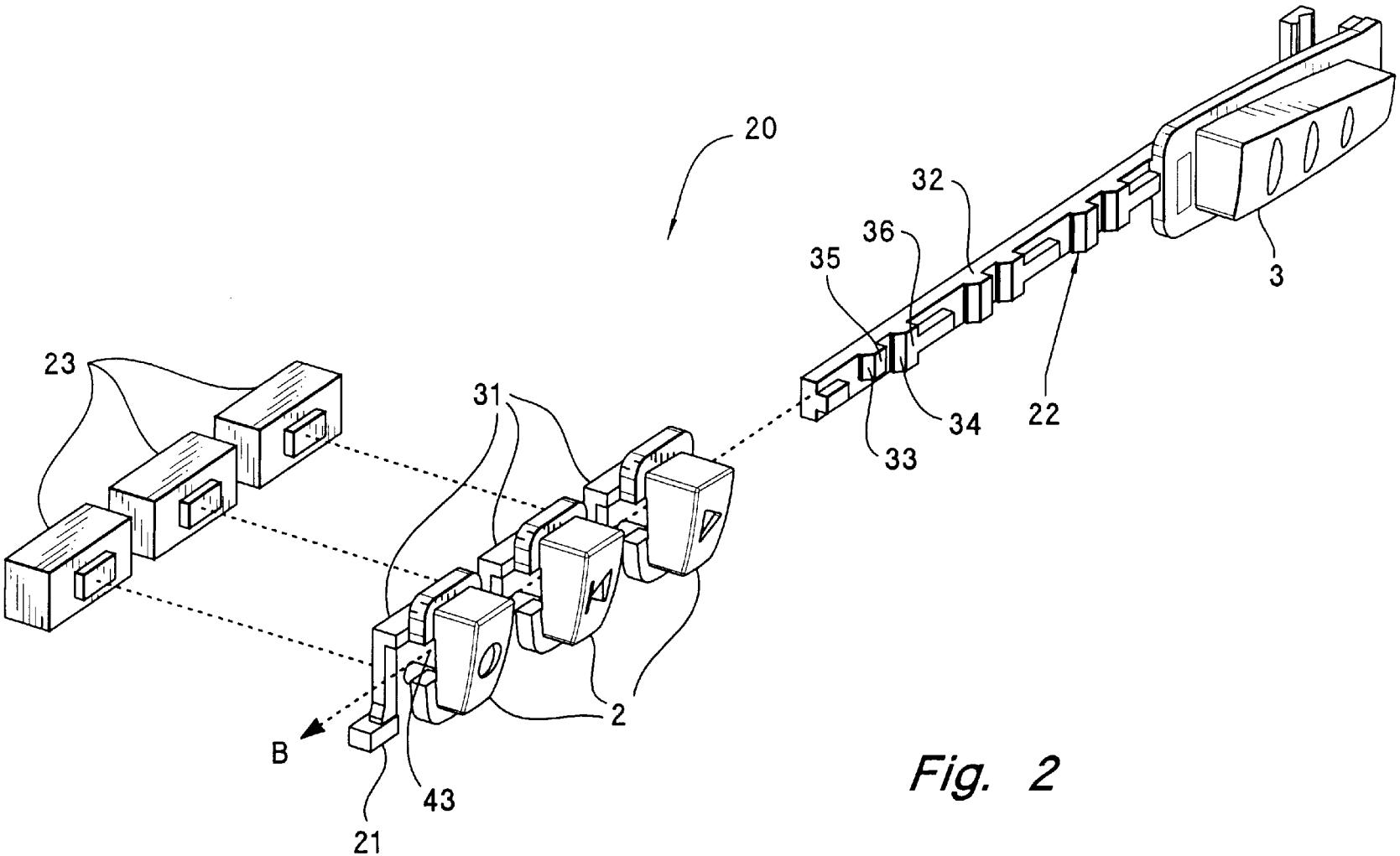
FIG. 2 is an exploded perspective view of the elements of a lockable button mechanism in accordance with the invention for use in the portable computer of FIG. 1.
Figure 3A:
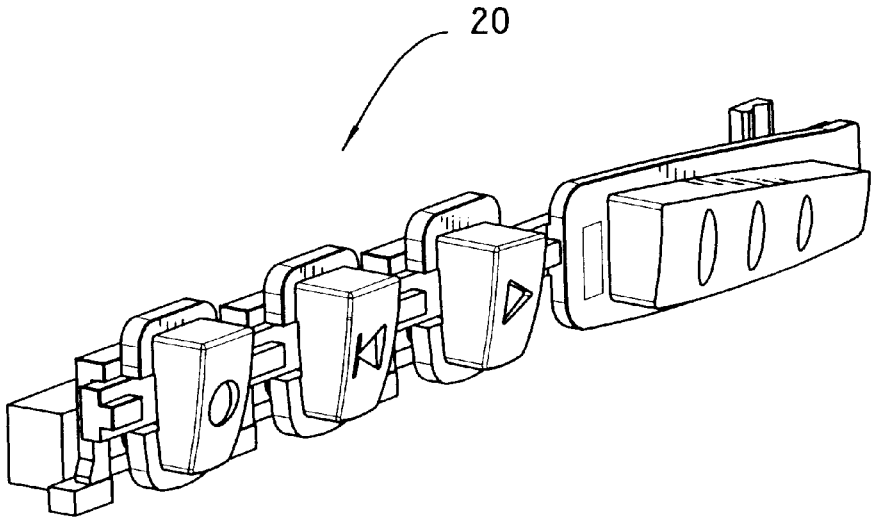
Figure 4A:
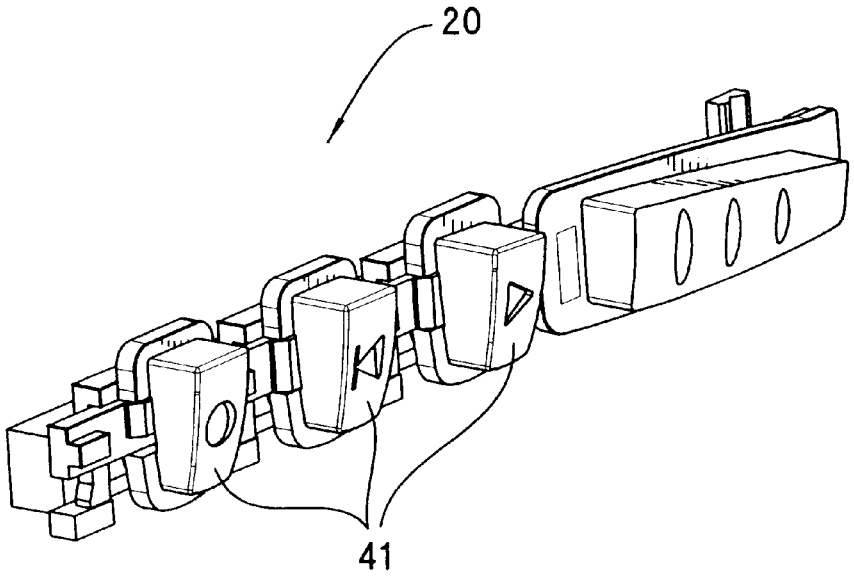
Figure 3B:
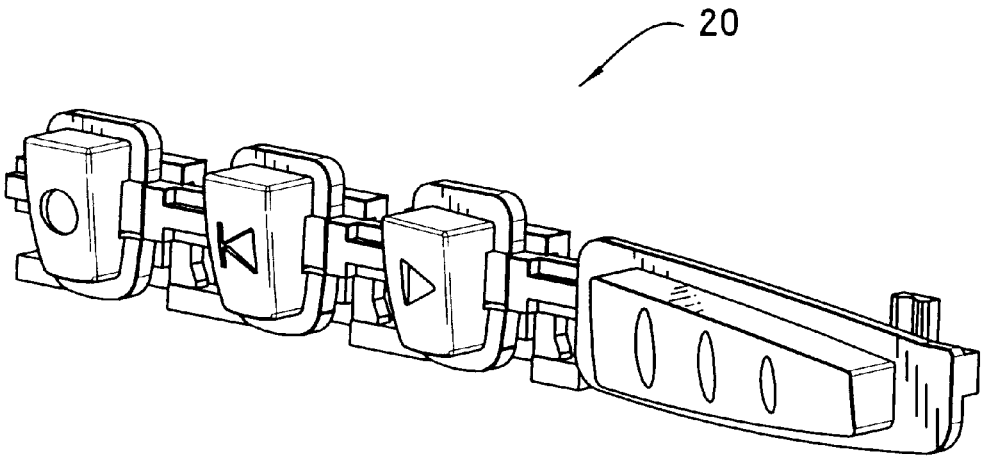
Figure 4B:
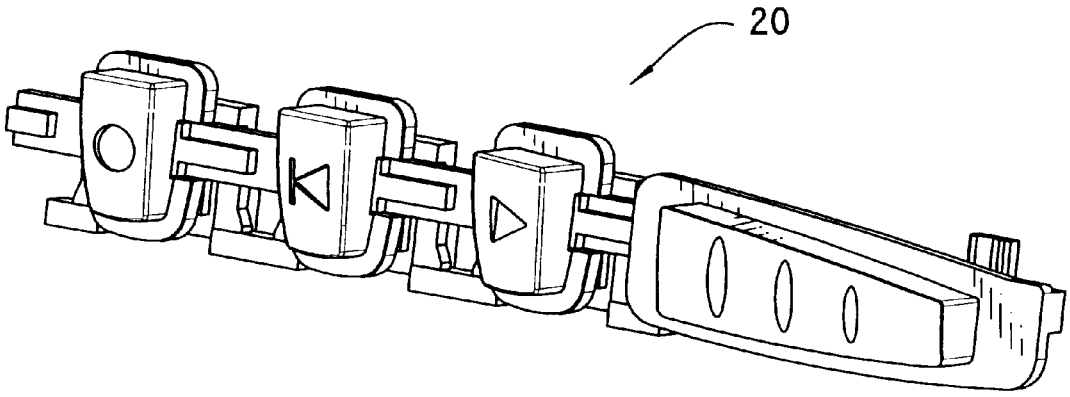
Figure 5B:
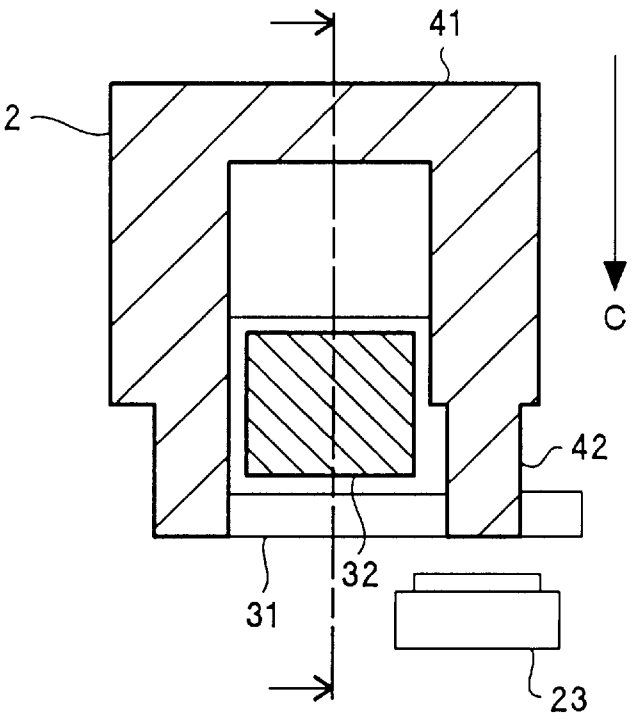
Figure 5A:
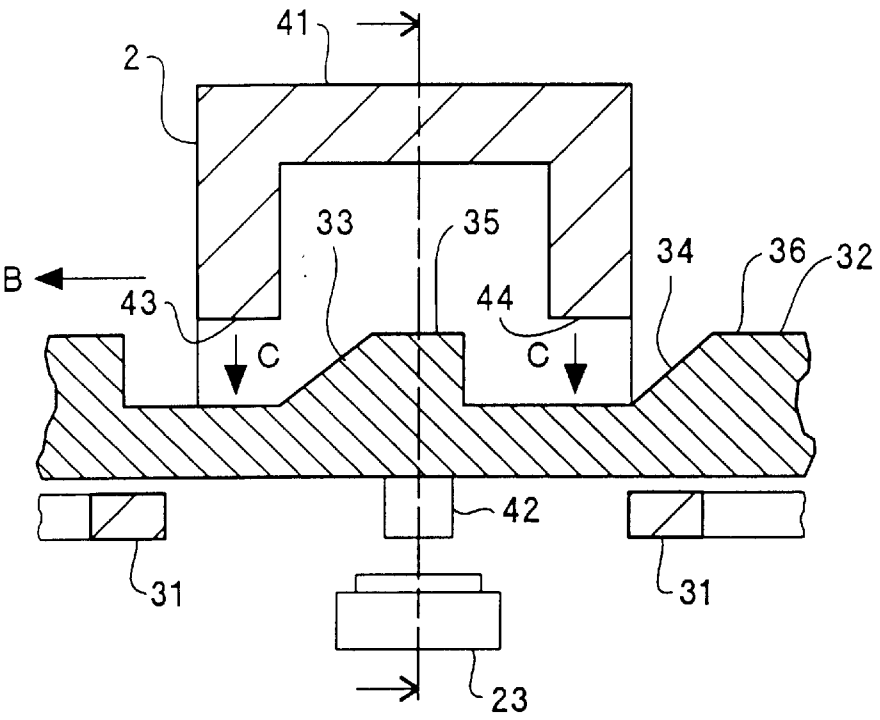
Figure 6B:
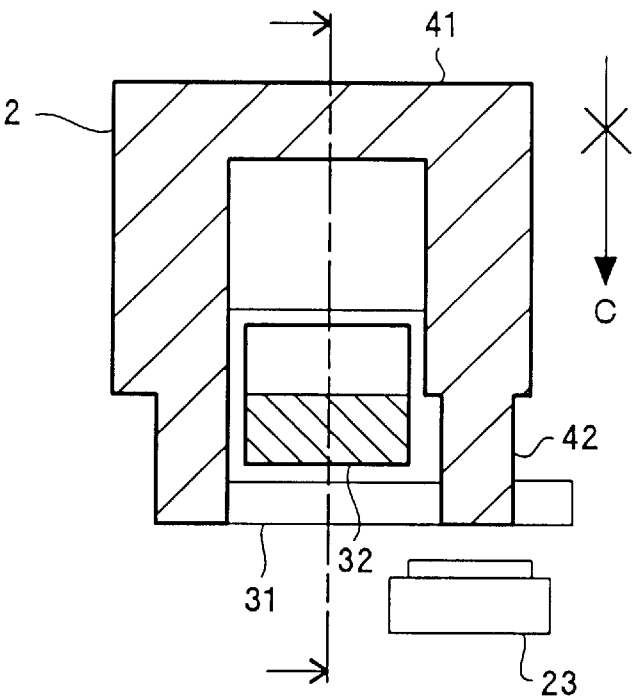
Figure 6A:
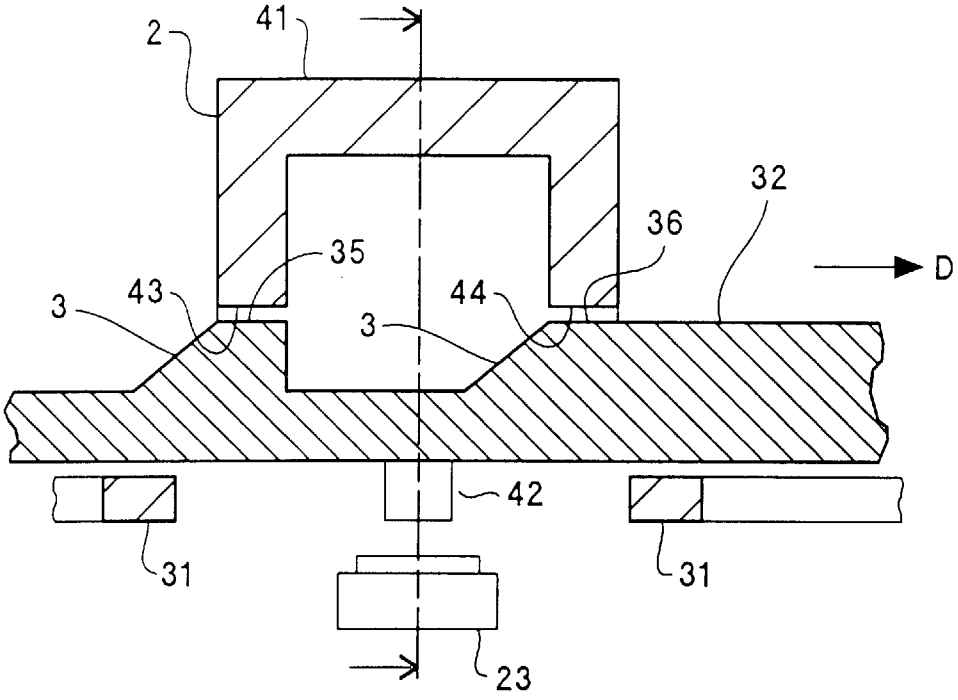

FIG. 3*a* is an assembled perspective view of the lockable button mechanism of FIG. 2 in an unlocked state;

FIG. 3*b* is an assembled perspective view similar to FIG. 3*a* except from a reverse angle;

FIG. 4*a* is an assembled perspective view of the lockable button mechanism of FIG. 2 in a locked state;

FIG. 4*b* is an assembled perspective view similar to FIG. 4*a* except from a reverse angle;

FIGS. 5*a* and 5*b* are sectional views of the lockable button mechanism in an unlocked state; and FIGS. 6*a* and 6*b* are sectional views of the lockable button mechanism in a locked state.

Figure 1:
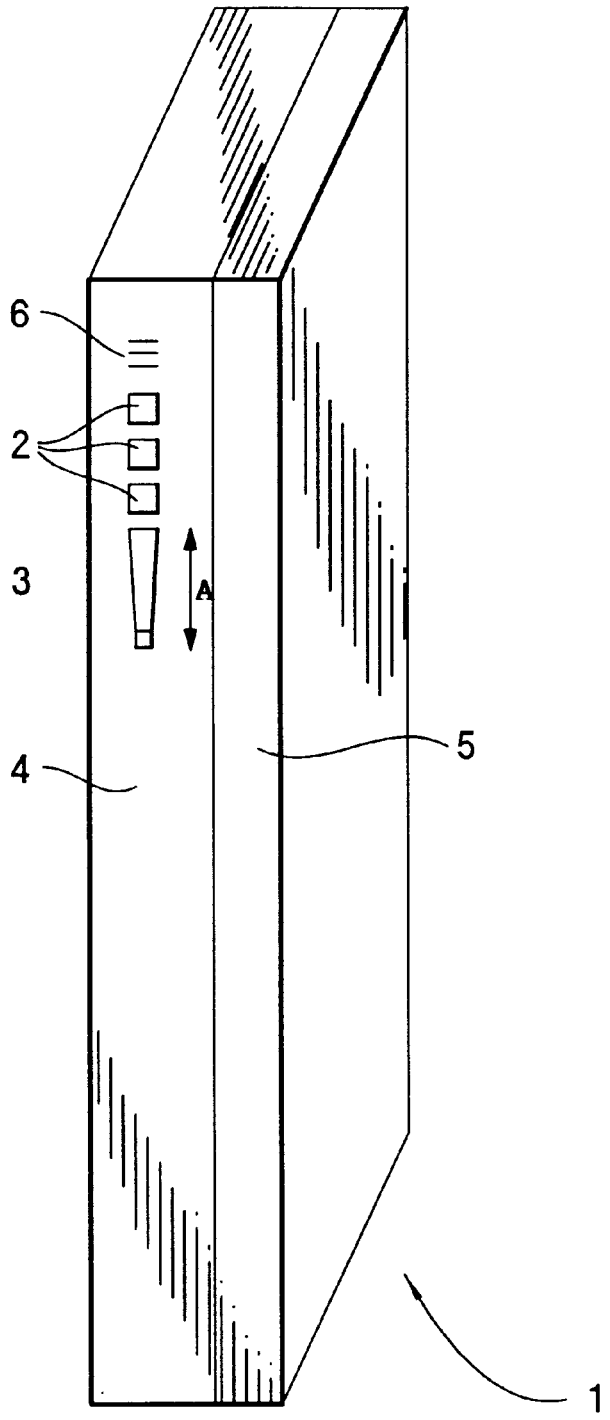
FIG. 1 is a perspective view of a portable computer with audio buttons positioned on an outer casing.

Referring to FIG. 1, there is shown a portable computer 1 with three audio buttons 2 and a locking button 3 positioned in-line on an outer casing or housing 4. The housing 4 includes a cover 5 which can be opened about a hinge (not shown) to reveal further buttons on a keyboard together with a touch screen display familiar to those skilled in the portable computer art.

The audio buttons 2 enable a user to record and play sounds such as voice memos without opening the cover 5. These sounds are input using a microphone 6 positioned adjacent the audio buttons 2. The sounds are output using a speaker (not shown). The three audio buttons are preferably associated with the functions record, play next, and play previous. However, other audio functions may be associated with the audio buttons 2.

The locking button 3 is disposed so as to be slidable relative to the housing 4 towards and away from the audio buttons 2 as indicated by arrow A in FIG. 1. The locking button is linked with the audio buttons 2 such that when the locking button is urged towards the audio buttons, the audio buttons become fixed in place so that they cannot be depressed. Conversely, when the locking button is urged away from the audio buttons, the path of the audio buttons 2 is cleared such that they may be depressed as and when desired.

To record a sound into the portable computer 1, a user firstly slides the locking button away from the audio buttons 2. The user then presses and holds the record audio button 2. The microphone picks up sounds until the record audio button is released whereupon the recording stops.

To play a sound saved in the portable computer 1, a user again slides the locking button away from the audio buttons. The user may then press either the play next button or the play previous button to select desired recordings for playback. The selected recording is then played back to the user.

When a user has finished recording or playing back sounds, he may lock the audio buttons by sliding the locking button towards the audio buttons.

FIG. 2 reveals the separate elements of a complete lockable button mechanism 20 according to the invention. The mechanism includes the audio buttons 2 and the locking button 3 described previously with reference to FIG. 1. The audio buttons 2 form part of a unitary button member 21 which includes a coupling frame 31 located behind the audio buttons 2. Similarly, the locking button 3 forms part of a unitary locking member 22 which includes a longitudinal locking element or rail 32. The button member 21 and the locking element 22 may each be made, for example, of a plastics material. The button mechanism 20 also includes switch elements 23 which are coupled to sense lines of a microprocessor (not shown). The switch elements may be standard push switches known to those skilled in the art.

As generally indicated by the dashed lines in FIG. 2, assembly of the lockable button mechanism 20 involves aligning the buttons 2 with their respective switch elements 23 and inserting the locking element 32 in a lengthwise direction B into a channel formed by the unitary button member 21. The lockable button mechanism 20 is shown fully assembled in FIG. 3*a*, 3*b*, 4*a* and 4*b*.

The operation and interaction of the elements of the lockable button mechanism 20 will now be described with further reference to FIGS. 5*a*, 5*b*, 6*a*, and 6*b*. These Figures show a single pair of aligned button and switch elements from the assembled button mechanism 20 together with an associated portion of the locking element.

Reference is firstly made to FIGS. 5*a* and 5*b*, which illustrate the button mechanism in an unlocked state. The button 2 comprises a button cap having an upper exposed surface 41 which is arranged in the portable computer so at to be depressible by a user. The button 2 is coupled on one side to the frame 31 such that upon depression by a user, the button 2 is forcibly rotated against the compliance of the material in the direction C towards the switch element 23. Further depression causes a cylindrical plunger portion 42 of the button 2 to make contact with and activate the switch element 23. The locking element 32 can be seen passing through a channel formed by the button 2 and the frame 31. However, the locking element is positioned so as not to obstruct the path of the button 2 during activation of the switch element 23.

When it is desired to lock the button mechanism 20, the user slides the locking button 3 towards the audio buttons 2. This in turn causes the locking element 32 to slide lengthwise in the direction B, with the element being guided by the three channels formed by the audio buttons 2. The locking element 32 slides in direction B until it reaches the position shown in FIGS. 6*a* and 6*b*, in which the button mechanism is in a locked state. In this position, raised surfaces 35, 36 of the locking element 32 abut lower engaging surfaces 43, 44 of the button cap. Because the lower engaging surfaces 43, 44 of the button cap are opposite to the upper exposed surface 41, the button is prevented from being depressed in the direction of arrow C. Thus, the switch element is unable to be activated. The downward forces which are applied to the locking element 32 by depression of the button cap are countered by reacting upward forces provided by the frame 31.

When it is desired to unlock the button mechanism once more, the user simply slides the locking element 32 back in the direction of arrow D to the position shown in FIGS. 5*a* and 5*b*.

In order to ensure a smooth transition from the unlocked state to the locked state, the locking element includes sloping camming surfaces 33, 34 which are designed to engage the leading edge of the lower engaging surfaces 43, 44 to urge the engaging surfaces upwards onto the raised surfaces 35, 36.

It will be evident in view of the foregoing description that various modifications may be made within the scope of the present invention. For example, the buttons 2 need not necessarily perform audio functions, but could instead perform a variety of non-audio functions in the computer.

What is claimed is:

1. A lockable button mechanism for use in a portable device, comprising:

a switch element;

a button aligned with the switch element, the button being depressible in a first direction to activate the switch element; and a locking element substantially interposed between the switch element and the button, the locking element being slidably displaceable in a transverse direction to the first direction between a first position in which depression of the button is enabled and a second position in which the locking element blocks depression of the button, and wherein the locking element has a longitudinal rail portion which is coupled to a slidable locking button.

* * * * *